US008515327B2

(12) United States Patent
Hatazaki

(10) Patent No.: US 8,515,327 B2
(45) Date of Patent: Aug. 20, 2013

(54) IMAGE FORMING APPARATUS

(75) Inventor: Kazunari Hatazaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 13/278,777

(22) Filed: Oct. 21, 2011

(65) Prior Publication Data

US 2012/0114402 A1 May 10, 2012

(30) Foreign Application Priority Data

Nov. 4, 2010 (JP) ..... 2010-247569
Oct. 4, 2011 (JP) ..... 2011-219903

(51) Int. Cl.
*G03G 15/20* (2006.01)

(52) U.S. Cl.
USPC ..... 399/341; 399/45; 399/406

(58) Field of Classification Search
USPC ..... 399/45, 341, 406
See application file for complete search history.

(56) References Cited

U.S. PATENT DOCUMENTS 5,850,589 A 12/1998 Cruz et al.
6,259,887 B1 7/2001 Awano
7,248,828 B2 * 7/2007 Segerer et al. ..... 399/341

FOREIGN PATENT DOCUMENTS

WO 2012/001875 A1 1/2012

* cited by examiner

*Primary Examiner* — Hoang Ngo
(74) *Attorney, Agent, or Firm* — Fitzpatrick, Cella, Harper & Scinto

(57) ABSTRACT

The invention provides an image forming apparatus capable of preventing a ripple or curling of the sheet and stabilizing feedability or loadability of the sheet. The image forming apparatus includes an aqueous solution applying portion that applies the aqueous solution containing the deliquescent material for hindering evaporation of moisture to the sheet where the toner image has been thermally fixed by the fixing portion, and a controller that controls so that a concentration of the deliquescent material of the aqueous solution applied to the sheet using the aqueous solution applying portion is changed depending on the basis weight of the sheet.

13 Claims, 6 Drawing Sheets

IMAGE FORMING APPARATUS

BACKGROUND OF THE INVENTION

1. Field of the Invention

The present invention relates to an image forming apparatus which reduces a ripple or curling of a sheet by applying moisture or an aqueous solution to the sheet having an image that is formed using an electrophotographic system and fixed by a fixing unit.

The invention can be applied to a technique for suppressing a ripple or curling of a sheet by applying moisture or an aqueous solution to the sheet in a fixing unit provided in an electrophotographic system image forming apparatus and the like.

2. Description of the Related Art

In the related art, an image forming apparatus using an electrophotographic system develops a latent image formed on a photosensitive drum as an image bearing member to convert the latent image into a visible image, and transfers the visible image (toner image) onto a sheet using an electrostatic force. Then, the transferred image is thermally fixed so that an image is recorded and formed on the sheet.

In the image forming apparatuses, such as an electrophotographic apparatus and an electrostatic recording apparatus, which form an image using toner, the toner image formed on the sheet is thermally pressed to be fixed. In the related art, as a fixing unit in the image forming apparatus using an electrophotographic system such as a copying machine, there is known a heat-roller fixing unit that fixes the toner image on a sheet. In the heat-roller fixing unit, a heat-roller fixing technique is employed, in which a fixing nip portion is formed by pressing a pressure roller against a fixing roller having a heater embedded therein to perform image fixation.

In the heat-roller fixation type fixing unit, a sheet is introduced into a pressing nip portion (fixing nip portion) obtained by pressing the pressure roller having elasticity and the fixing roller heated by an internal heat source such as a halogen heater to each other to maintain the roller surface at a predetermined temperature, and the sheet is conveyed while the sheet is nipped. As a result, an unfixed toner image is thermally fixed on the sheet surface. In this process, since heat and pressure are applied to the toner and the sheet, moisture inside the sheet is evaporated while the sheet is pressed.

A ripple and curling occur in a paper sheet due to the moisture amount change of the sheet and the stress applied to the sheet during the above-mentioned fixing process. In terms of a fiber level of the paper sheet, paper is a tangle of fibers, and moisture is contained inside or between fibers, so that a hydrogen bonding is generated between the fibers and water.

In the fixing process, if heat and pressure are applied to the paper sheet, a deviation occurs between fibers due to the pressure. If heat is applied to evaporate moisture in this state, a hydrogen bonding is generated between fibers, so that the sheet is deformed. If the sheet is left as it is, moisture is absorbed, and the hydrogen bonding between fibers is separated again depending on the surroundings. However, moisture is not introduced into some fibers, and deformation of the sheet is maintained. The pattern of deformation includes deformation (curling) caused by a difference of expansion and contraction between the front and rear sides of the sheet and deformation caused by a difference of expansion and contraction between the center and the edge of a sheet. Such deformation generates a ripple or curling of a sheet.

A solution for addressing such a problem has been proposed in U.S. Pat. No. 5,850,589, which discloses an apparatus and system used in an electrostatic copy apparatus to prevent the ripple in the edge and curling caused by removing moisture from a paper sheet during the fixing process in the electrostatic copy or print. The proposed apparatus is an apparatus for applying a controlled moisture amount to one or both of surfaces of the sheet, and includes a water-jet which is arranged in both sides of the sheet and has a reservoir for storing a liquid and a pair of pressure rollers having a substantially cylindrical outer surface.

Positions of a pair of pressure rollers are adjusted along their axes to define a nip portion between the cylindrical outer surfaces. This apparatus further includes a control device for controlling moisture applied from the water-jet to a selected part of each passing sheet before the sheet is introduced into the nip portion formed between the cylindrical outer surfaces. As the sheet passes through the fixing unit, the moisture amount in the sheet is reduced to generate a ripple and curling. For this phenomenon, the lost moisture is compensated for by supplementing moisture after the fixing so that a ripple and curling can be alleviated.

The ripple and curling are corrected by compensating for the moisture lost by the heat and pressure during the image fixing process by supplementing moisture to the sheet. As the moisture amount of the sheet increases, a Young's modulus of the sheet itself is reduced, and stiffness is degraded, so that a ripple can be alleviated. It is contemplated that, if moisture is introduced into the gap between fibers, the fixing unit separates the bonding of fibers which was a hydrogen bonding once so that a ripple can be alleviated.

In the technique of U.S. Pat. No. 6,259,887, there are provided a conveying portion that conveys a sheet and a spray device that applies moisture to the sheet by spraying water droplets onto the sheet conveyed by the conveying portion. In addition, there is provided a water amount controlling portion that controls a water feed amount of the water feeder depending on the type of the sheet, an image formed on the sheet, an atmospheric temperature, or humidity. Similar to U.S. Pat. No. 5,850,589, U.S. Pat. No. 6,259,887 has been developed to supplement moisture lost by the heat and pressure during the image fixing process and correct the ripple and curling. Furthermore, in the technique of U.S. Pat. No. 6,259,887, the water feed amount is changed depending on the type of the sheet, the image, and the atmosphere, and a suitable amount of water is provided to each sheet depending on each condition, so that the ripple and curling can be alleviated.

However, according to U.S. Pat. No. 5,850,589, while moisture of the sheet is reduced to generate a ripple and curling as it passes through the fixing unit, the lost moisture is supplemented by applying moisture after the fixing so that the ripple and curling can be alleviated. Unfortunately, even when the ripple and curling are alleviated temporarily by applying moisture to the paper sheet, the ripple or curling of the sheet may problematically increase again if the applied moisture is evaporated to dry the sheet.

In addition, according to U.S. Pat. No. 6,259,887, while the feed amount of the water feeder is adjusted depending on the type of the sheet, the image formed on the sheet, the atmospheric temperature or humidity, feedability or loadability is influenced if the amount of water applied to the sheet is changed. For example, if the spray amount is too much, water droplets may remain on the surface so that a sheet may stick to a guide during conveying, or sheets may stick to each other during loading.

The invention provides an image forming apparatus capable of alleviating the ripple on each sheet by maintaining a suitable amount of moisture on the sheet without degrading feedability or loadability of the sheet.

SUMMARY OF THE INVENTION

The present invention is directed to an image forming apparatus including an image forming portion that forms a toner image on a sheet, a fixing portion that thermally fixes the toner image formed on the sheet, and an aqueous solution applying portion that applies an aqueous solution containing a deliquescent material for hindering evaporation of moisture to the sheet where the toner image has been thermally fixed by the fixing portion, wherein a concentration of the deliquescent material of the aqueous solution applied to the sheet using the aqueous solution applying portion is changed depending on a basis weight of the sheet.

In the above-mentioned configuration, it is possible to change the concentration of the deliquescent material contained in the aqueous solution according to the basis weight of the sheet when the aqueous solution containing the deliquescent material for hindering evaporation of moisture is sprayed onto the sheet where the toner image has been thermally fixed. As a result, since a suitable moisture amount can be maintained depending on the basis weight of the sheet. Therefore, it is possible to appropriately alleviate a ripple in each sheet. Since the spray amount of the aqueous solution is constant, it is possible to stabilize feedability or loadability of the sheet.

Further features of the present invention will become apparent from the following description of exemplary embodiments with reference to the attached drawings.

DESCRIPTION OF THE EMBODIMENTS

Figure 1:
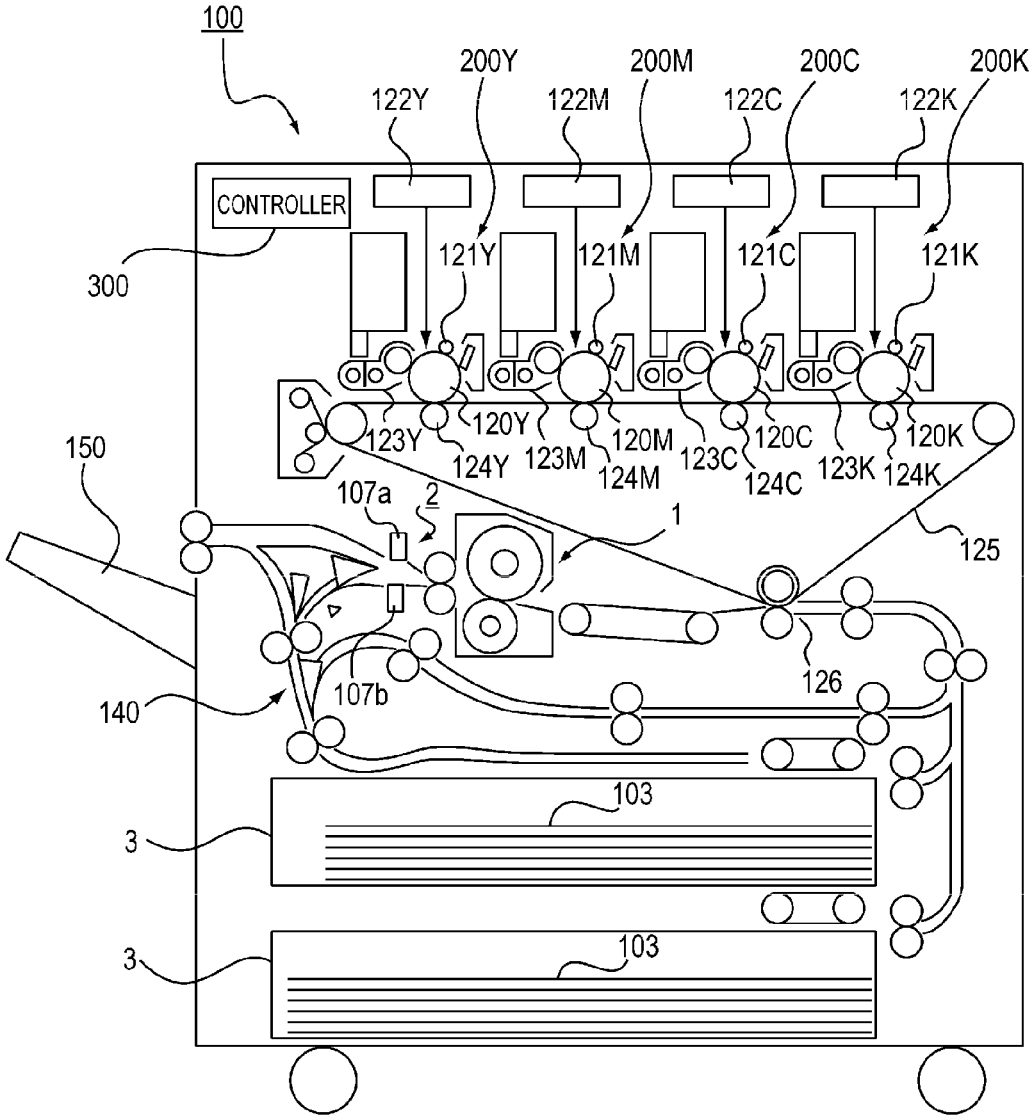
FIG. 1 is a schematic configuration diagram illustrating an image forming apparatus having an aqueous solution applying device according to an embodiment of the invention.

Hereinafter, a configuration of the image forming apparatus having an aqueous solution applying device according to an embodiment of the invention will be described with reference to FIG. 1. FIG. 1 illustrates a full-color intermediate transfer type image forming apparatus as a detailed example of the image forming apparatus according to an embodiment of the invention. In this case, an apparatus body 100 of the image forming apparatus includes an image forming portion for forming a toner image on a paper sheet 103. As the image forming portion, for example, image forming portions 200Y, 200M, 200C, and 200K corresponding to yellow (Y), magenta (M), cyan (C), and black (K), respectively, are arranged in series.

Specifically, the image forming apparatus illustrated in FIG. 1 is a tandem type image forming apparatus in which processes up to visualization are processed in parallel on each color basis. Hereinafter, for brevity purposes, four image forming portions 200Y, 200M, 200C, and 200K corresponding to Y, M, C, and K, respectively, will be representatively described as an image forming portion 200. Similar assumption will be made in each of the following related process portions. The arrangement sequence of the image forming portions of Y, M, C and K is not limited thereto. In addition, the invention may be similarly applied to a monochromatic image forming apparatus without limiting to the full-color intermediate transfer type image forming apparatus.

Each image forming portion 200 has each image processing portion as follows. Each image processing portion is controlled by a controller 300 which controls whole of the image forming apparatus. For each color of Y, M, C, and K, primary charging units 121Y, 121M, 121C, and 121K, and image bearing members 120Y, 120M, 120C, and 120K for bearing electrostatic latent images on the surface are provided. In addition, exposing units 122Y, 122M, 122C, and 122K, and developing units 123Y, 123M, 123C, and 123K are provided. The primary charging unit 121 applies a charging bias voltage of an established electric potential to the surface of the corresponding image bearing member 120 to uniformly charge the surface, and the exposing unit 122 exposes the surface, so that an electrostatic latent image is formed. The electrostatic latent image is visualized as a toner image by developing the toner using the developing unit 123.

Each toner image formed and borne on the surface of the image bearing member 120 is primarily transferred onto the intermediate transfer member 125 having an endless belt in a sequentially superimposed manner using the primary transfer units 124Y, 124M, 124C and 124K. The toner image primarily transferred onto the intermediate transfer member 125 for all colors of Y, M, C, and K is secondarily transferred onto the sheet 103 using the secondary transfer unit 126. The sheet 103 that bears the transferred toner image is conveyed to the fixing unit 1 having a fixing portion for thermally fixing the toner image onto the sheet 103 where an image has been formed.

In the fixing unit 1, the toner image of the sheet 103 is fixed by applying heat and pressure to the unfixed toner image while the fixing nip portion nips the sheet 103. In addition, the aqueous solution applying portion 2 (aqueous solution applying device) is provided to apply the aqueous solution containing the deliquescent material for hindering evaporation of moisture on the sheet 103 on which the toner image has been thermally fixed by the fixing unit 1 after the sheet 103 passes through the fixing unit 1.

It is noted that deliquescence refers to a phenomenon that a substance catches moisture in the air to become an aqueous solution. When the concentration of the aqueous solution reaches a certain value, moisture absorption stops. Moisture in the air is absorbed in a deliquescence material so as to become a saturated aqueous solution. The amount of crystals is sufficiently large, and all of the crystals are not dissolved out although some of crystals are dissolved in the water.

Therefore, as the amount of the saturated aqueous solution continuously increases, all of the crystals are dissolved, and the water vapor pressure of the solution is reduced until it is equal to the water vapor pressure in the air. The water absorption stops when an equilibrium state is obtained between the water vapor pressure in the air and the water vapor pressure in the aqueous solution.

The spray nozzles 107*a* and 107*b* of the aqueous solution applying portion 2 are arranged such that the aqueous solution 109*a* can be sprayed onto both surfaces of the sheet 103.

The aqueous solution 109*a* containing the deliquescent material is selectively applied to one or both surfaces of the sheet 103 using the aqueous solution applying portion 2 before the sheet 103 is dried by the fixing portion of the fixing unit 1 to obtain an equilibrium state between the moisture amount of the sheet 103 and the surroundings. Then, the sheet 103 is conveyed to the discharge tray 150 of the apparatus body 100 or the sheet duplex conveying path 140.

As described above, in the apparatus body 100, a series of image forming processes such as charging, exposure, development, transferring, and fixing are executed to form a color toner image on the sheet 103 such as a recording sheet or OHP sheet, and are discharged to the discharge tray 150. In addition, in the case of a monochromatic image forming apparatus, only the image bearing member 120K of black (K) is provided, and the toner image formed on the image bearing member 120K is transferred onto the sheet 103 using the primary transfer unit 124K.

Figure 2:
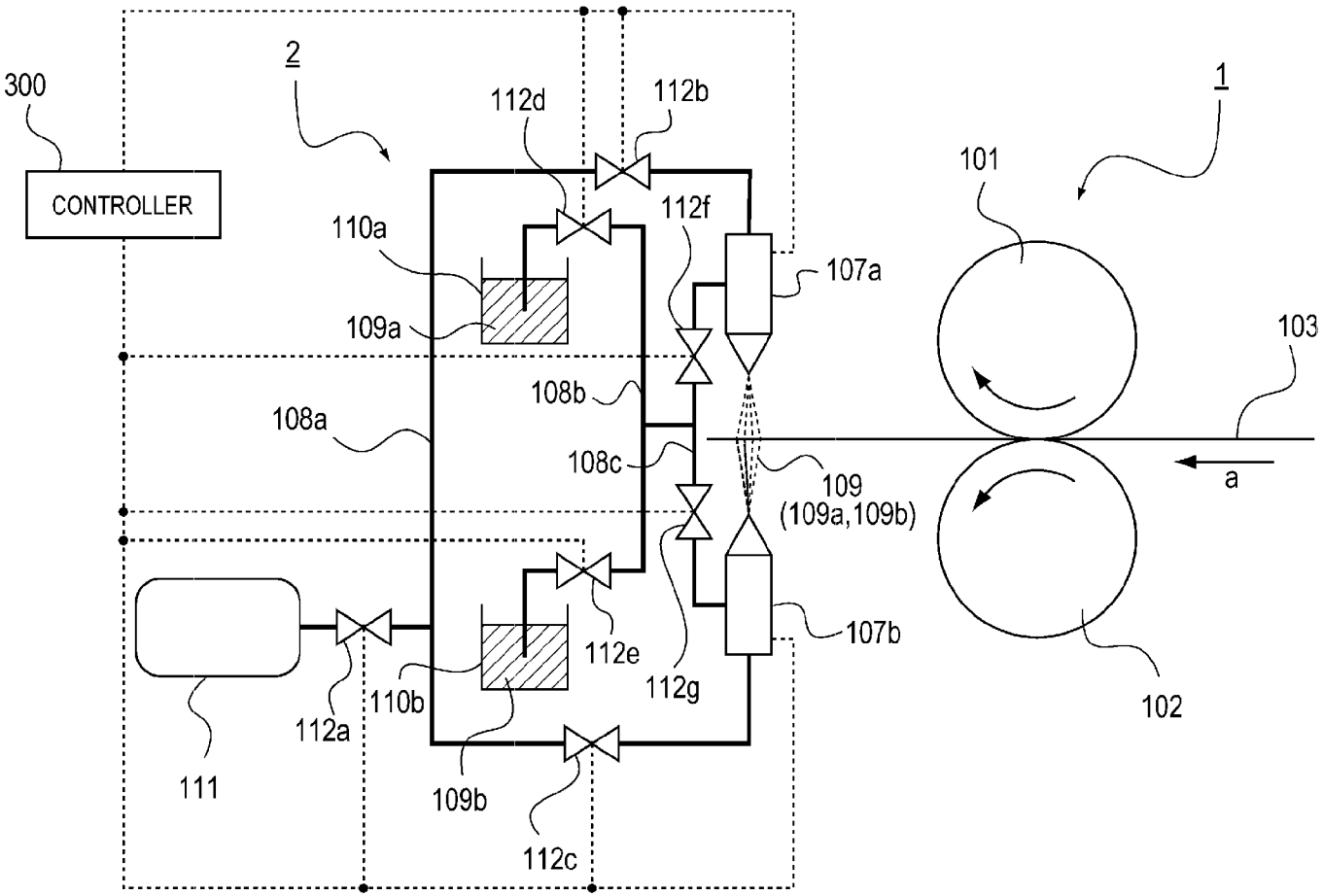
FIG. 2 is a schematic diagram illustrating an aqueous solution applying device that sprays an aqueous solution containing a deliquescent material onto the sheet according to an embodiment of the invention.

FIG. 2 is a schematic cross-sectional view illustrating a configuration of the aqueous solution applying portion 2 for applying the aqueous solution 109*a* containing the deliquescent material to the sheet 103 where the fixing unit 1 serving as a fixing portion thermally fixes the toner image. The aqueous solution applying portion 2 illustrated in FIG. 2 applies, to the sheet 103, the aqueous solution 109*a* containing the deliquescent material for hindering evaporation of moisture from the sheet 103 and the aqueous solution 109*b* containing the surfactant for promoting permeability of the aqueous solution on the sheet 103 where the toner image has been thermally fixed by the fixing unit 1.

In the aqueous solution applying portion 2, the aqueous solution 109*a* containing the deliquescent material and the aqueous solution 109*b* containing the surfactant are applied to the sheet 103, where the toner image has been thermally fixed by the fixing unit 1, separately or as a mixed aqueous solution obtained by mixing both solutions 109*a* and 109*b*.

In the FIG. 2, the fixing unit 1 includes a fixation rotating member 101 having a heating portion and a pressing rotating member 102 provided to press the fixation rotating member 101. In addition, the fixation rotating member 101 and the pressing rotating member 102, the image fixation is performed by heating and pressing the unfixed toner image on the sheet 103. After the sheet 103 passes through the fixing unit 1, the aqueous solution 109*a* containing the deliquescent material is sprayed onto the sheet 103. The arrow a of FIG. 2 denotes a conveying direction of the sheet 103.

In the aqueous solution applying portion 2, two spray nozzles 107*a* and 107*b* are provided to spry the aqueous solution 109*a* containing the deliquescent material and the aqueous solution 109*b* containing the surfactant onto both surfaces of the sheet 103 separately or as a mixed aqueous solution 109 obtained by mixing both solutions 109*a* and 109*b*. In addition, a compressor 111 for supplying a compressed air to the spray nozzles 107*a* and 107*b* are provided.

Two reservoirs 110*a* and 110*b* are provided to supply the aqueous solution 109*a* containing the deliquescent material and the aqueous solution 109*b* containing the surfactant to the spray nozzles 107*a* and 107*b*. According to the present embodiment, the reservoir 110*a* stores the aqueous solution 109*a* containing the deliquescent material, and the reservoir 110*b* stores the aqueous solution 109*b* containing the surfactant.

Tubes 108*a* to 108*c* are provided to supply the aqueous solutions 109*a* and 109*b* from the reservoirs 110*a* and 110*b* and the compressed air from the compressor 111 to the spray nozzles 107*a* and 107*b* separately or mixedly. In addition, valves 112*a* to 112*g* are provided to open and close supplying of the compressed air and the aqueous solutions 109*a* and 109*b*.

Two spray nozzles 107*a* and 107*b* are installed using a fixation tool (not illustrated) in the middle of the sheet conveying path after the sheet 103 passes through the fixing unit 1, and the toner image is fixed on the sheet 103. The aqueous solutions 109*a* and 109*b* are sprayed onto the paper sheet 103 from either of two spray nozzles 107*a* or 107*b*. As a result, the aqueous solutions 109*a* and 109*b* are sprayed onto the sheet 103 after the sheet 103 passes through fixing unit 1. The spray nozzles 107*a* and 107*b* are arranged to spray the aqueous solution 109 onto both surfaces of the sheet 103 in the middle of the sheet conveying path, so that the aqueous solution 109 containing the aqueous solutions 109*a* and 109*b* is selectively applied to either or both surfaces of the sheet 103.

In the configuration of the aqueous solution applying portion 2 illustrated in FIG. 2, only the aqueous solution 109*a* containing the deliquescent material stored in the first reservoir 110*a* may be supplied to the spray nozzles 107*a* and 107*b* in some cases. In this case, the valve 112*e* is closed, and other valves 112*a* to 112*d*, 112*f*, and 112*g* are opened. As a result, only the aqueous solution 109*a* containing the deliquescent material can be supplied to the spray nozzles 107*a* and 107*b*.

When only the aqueous solution 109*b* containing the surfactant stored in the second reservoir 110*b* is supplied to the spray nozzles 107*a* and 107*b*, the valve 112*d* is closed, and other valves 112*a* to 112*c* and 112*e* to 112*g* are opened. As a result, only the aqueous solution 109*b* containing the surfactant can be supplied to the spray nozzles 107*a* and 107*b*.

Furthermore, the aqueous solution 109 obtained by mixing the aqueous solution 109*a* containing the deliquescent material and the aqueous solution 109*b* containing the surfactant stored in the first and second reservoirs 110*a* and 110*b*, respectively, may be supplied to spray nozzles 107*a* and 107*b* in some cases. In this case, the aqueous solution 109 obtained by mixing the aqueous solution 109*a* containing the deliquescent material and the aqueous solution 109*b* containing the surfactant can be supplied to the spray nozzles 107*a* and 107*b* by opening all valves 112*a* to 112*g*.

That is, the aqueous solution applying portion 2 has at least two or more reservoirs 110. In addition, the aqueous solution 109*a* containing the deliquescent material may be stored in at least one first reservoir 110*a*, and water instead of the aqueous solution 109*b* containing surfactant may be stored in at least one of the other second reservoirs 110*b*. In addition, the aqueous solution 109 obtained by mixing the aqueous solution 109*a* containing the deliquescent material of the first reservoir 110*a* and water of the second reservoir 110*b* may be supplied to the spray nozzles 107*a* and 107*b* and applied to the sheet 103 where the toner image has been thermally fixed by the fixing unit 1.

Alternatively, the aqueous solution applying portion 2 has at least two or more reservoirs 110. In addition, the aqueous solution 109*a* containing the deliquescent material may be stored in at least one first reservoir 110*a*, and water instead of the aqueous solution 109*b* containing surfactant may be stored in at least one of the other second reservoirs 110*b*. In addition, the aqueous solution 109*a* containing the deliquescent material of the first reservoir 110*a* and water of the second reservoir 110*b* may be separately supplied to the spray nozzles 107*a* and 107*b* and applied to the sheet 103 where the toner image has been thermally fixed by the fixing unit 1.

The aqueous solution 109*a* sprayed onto the paper sheet 103 contains the deliquescent material for hindering evaporation of moisture, and the aqueous solution 109*b* contains the surfactant for increasing permeability of the aqueous solution to the sheet 103. By virtue of the permeability of the surfactant, the aqueous solution 109*a* containing the deliquescent material can be easily introduced into the gap between fibers of the sheet 103 made of paper, and the action of dissolving celluloses by separating the hydrogen bonding between fibers of paper can increase, so that a ripple or curling of the sheet 103 can be alleviated. If the permeability of the aqueous solution 109 is improved using the surfactant, it is possible to alleviate adhesion between upper and lower sheets when the sheets 103 are loaded.

According to the present embodiment, the concentration of the deliquescent material of the aqueous solution 109 applied to the sheet 103 by the aqueous solution applying portion 2 is changed depending on the basis weight which is a weight per unit area of the sheet 103. The concentration of the deliquescent material of the aqueous solution 109 applied to the sheet 103 depending on the basis weight of the sheet 103 is changed in synchronization when a user sets the sheets 103 in the sheet cassette 3, and selects the basis weight on an operation display screen provided in the apparatus.

Specifically, when the basis weight of the sheet 103 is selected, the controller 300 changes the open/close levels of the valves 112*a* to 112*g* of the aqueous solution applying portion 2 or the pressure of the compressor 111 to control the flow rate of the aqueous solution 109*a* containing the deliquescent material and the aqueous solution 109*b* containing the surfactant. As a result, the spray concentration of the deliquescent material of the aqueous solution 109 applied to the sheet 103 is changed. On the sheet 103 having a large basis weight (weight per unit area), the spray amount of the aqueous solution 109*a* containing the deliquescent material increases, and the amount of the aqueous solution 109*b* containing the surfactant is reduced. When the basis weight of the sheet 103 is small, the amount of the aqueous solution 109*a* containing the deliquescent material is reduced, and the amount of the aqueous solution 109*b* containing the surfactant increases to adjust the concentration of the deliquescent material of the aqueous solution 109.

The aqueous solution applying portion 2 according to the present embodiment uses the spray nozzles 107*a* and 107*b*. However, as a mechanism for applying the aqueous solution 109 onto the sheet 103, various other kinds of aqueous solution applying portions such as a water-jet mechanism or a coating roller may be applicable. Needless to say, the aqueous solution applying portion is not limited to the spray nozzles 107*a* and 107*b*.

Hereinafter, a result of investigation for change of the moisture evaporation amount depending on the basis weight of the sheet 103 will be described with reference to Table 1 and FIG. 3A. In the image forming apparatus that forms a toner image, the heat amount applied to the sheet 103 is changed depending on the basis weight of the sheet 103 to constantly maintain fixability of the toner onto the sheet 103. As a result, the moisture evaporation amount of the sheet 103 is different depending on the basis weight of the sheet 103. The change of the moisture evaporation amount depending on the basis weight of the sheet 103 is shown in Table 1 and FIG. 3A. The moisture evaporation amount was measured under the condition that the type of the sheet 103 is plain paper, a white solid image is formed on a one-sided plain paper sheet having a A3 size, and the basis weight is set to 64 g/m$^2$, 80 g/m$^2$, 160 g/m$^2$, and 250 g/m$^2$ to constantly maintain fixability.

TABLE 1

| BASIS WEIGHT [g/m$^2$] | MOISTURE AMOUNT [%] BEFORE SHEET PASSING | MOISTURE AMOUNT [%] AFTER PASSING THROUGH FIXING UNIT | MOISTURE EVAPORATION AMOUNT (SIZE: A3) [g] |
|---|---|---|---|
| 64 | 4.6 | 3.1 | 0.12 |
| 80 | 5.0 | 3.7 | 0.13 |
| 160 | 5.0 | 3.7 | 0.26 |
| 250 | 5.1 | 4.1 | 0.31 |

Figure 3A:
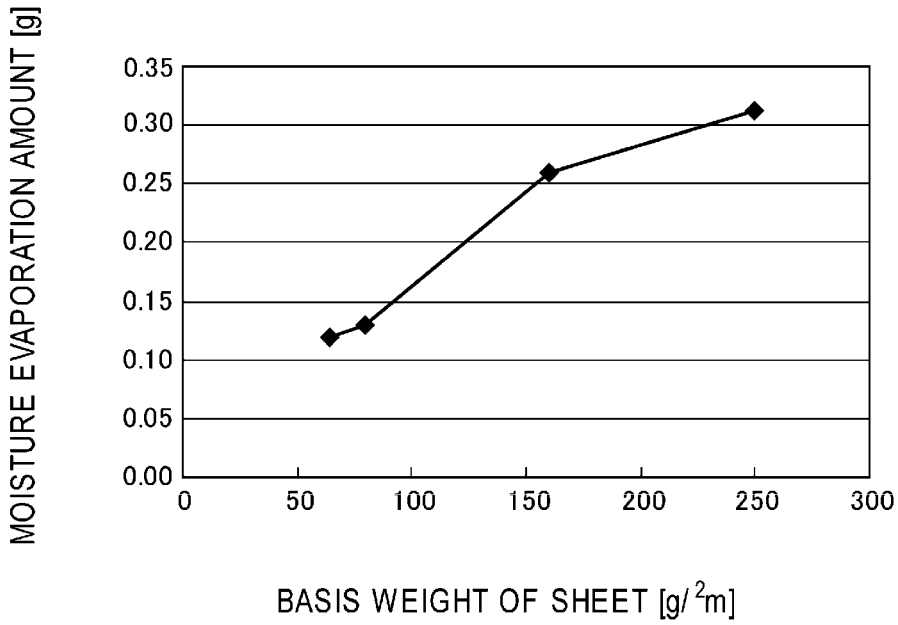
FIG. 3A is a diagram illustrating a moisture evaporation amount against a sheet basis weight.

As shown in Table 1 and FIG. 3A above, when the spray amount per unit area of the aqueous solution 109 to the sheet is constantly maintained, the moisture evaporation amount of the sheet having a basis weight of 80 g/m$^2$ was 0.13 g, and the moisture evaporation amount of the sheet having a basis weight of 250 g/m$^2$ was 0.31 g. That is, it is recognized that, even when the spray amount per unit area of the aqueous solution 109 is constantly maintained, the moisture evaporation amount of the sheet having a basis weight of 250 g/m$^2$ is approximately 2.4 times that of the sheet having a basis weight of 80 g/m$^2$. It is also recognized that the moisture evaporation amount is different depending on the basis weight of the sheet 103 when the heat amount applied to the sheet is changed depending on the basis weight of the sheet 103 to constantly maintain fixability.

Therefore, it is necessary to change the moisture amount supplied to the sheet 103 using the aqueous solution applying portion 2 depending on the basis weight of the sheet 103. However, since the spray amount per unit area of the aqueous solution 109 is changed for each sheet 103, feedability or loadability of the sheet 103 is influenced. In this regard, the concentration thereof is changed using the aqueous solution 109*a* containing the deliquescent material. As a result, the solution applying portion 2 is provided as illustrated in FIG. 2 to constantly maintain the spray amount per unit area of the aqueous solution 109 sprayed onto the sheet 103 regardless of the basis weight of the sheet 103.

It is noted that the deliquescent material catches moisture in the air, becomes an aqueous solution, and continuously absorbs water until the concentration of the aqueous solution reaches a certain value. Due to such a property, if the aqueous solution 109*a* obtained by mixing the deliquescent material and water is sprayed onto the sheet 103, the moisture amount held in the sheet 103 is changed depending on the concentration of the deliquescent material of the sprayed aqueous solution 109*a*. That is, it is possible to change the moisture amount of the sheet 103 by changing the concentration of the deliquescent material contained in the aqueous solution 109 applied to the sheet 103 even when the spray amount of the aqueous solution 109 applied to the sheet 103 is constant.

Next, an exemplary applicable deliquescent material will be described with reference to FIG. 3B. Water retainability of each deliquescent material is evaluated using moisture activity values thereof. As the moisture activity value is reduced, the water retainability increases. Particularly, a ripple and curling of the sheet 103 are effectively suppressed when the moisture activity value of the deliquescent material is equal to or lower than 0.6.

Figure 3B:
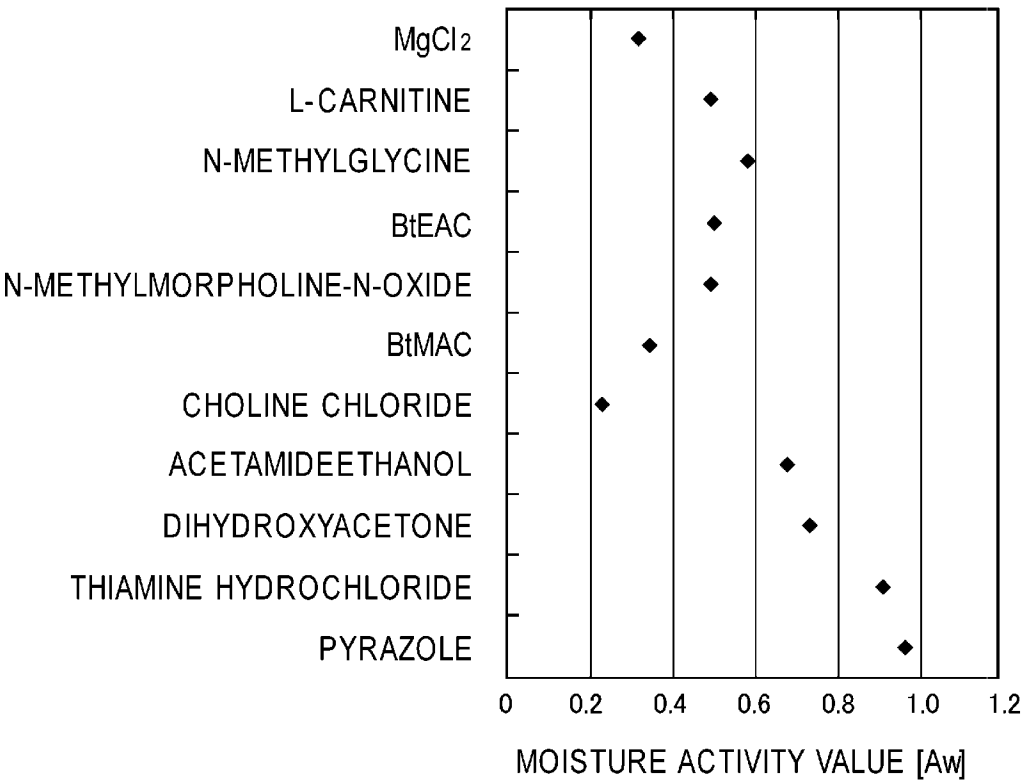
FIG. 3B is a diagram illustrating a moisture activity value of the deliquescent material.

As illustrated in FIG. 3B, the deliquescent material having a moisture activity value equal to or lower than 0.6 may include magnesium chloride ($MgCl_2$), L-carnitine, N-methylglycine, benzyltriethylammonium chloride (BtEAC). In addition, N-methylmorpholine-N-oxide (MMNO), benzyltrimethylammonium chloride (BtMAC), choline chloride, and the like may be used.

Figure 4A:
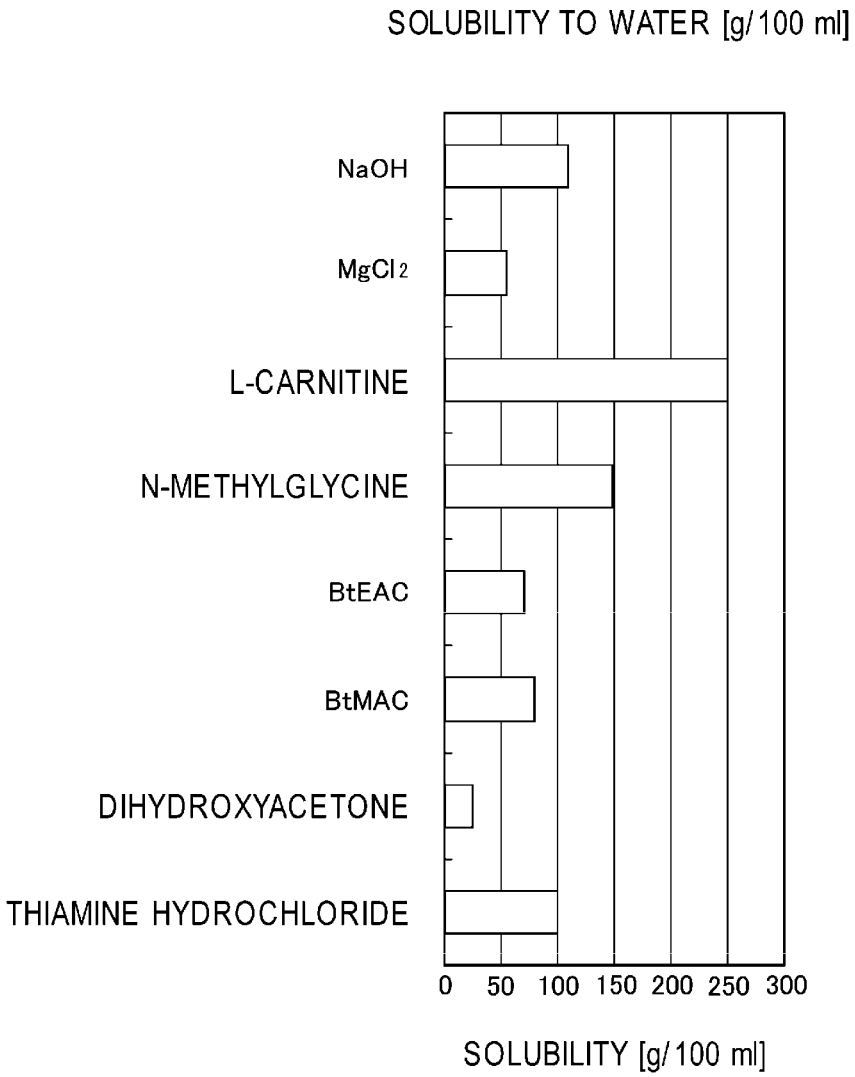
FIG. 4A is a diagram illustrating a water solubility of the deliquescent material.

The upper limit of the concentration of the aqueous solution 109 containing the deliquescent material (saturated aqueous solution concentration) is determined by the water solubility. FIG. 4A illustrates water solubility of the deliquescent material. Since the solubility is different for each type of the deliquescent material, the concentration of the saturated aqueous solution is also different. If the water solubility is small even when the moisture activity value is suitable, it is necessary to increase the amount of the sprayed aqueous solution 109, and thus, it is not suitable for use. In addition, there are many other deliquescent materials in addition to those illustrated in FIGS. 3A and 4A.

The change of the moisture amount was investigated by applying the above-mentioned deliquescent material to the paper sheet 103. As a mechanism for applying the aqueous solution 109*a* containing the deliquescent material, the spray nozzles 107*a* and 107*b* of the aqueous solution applying portion 2 illustrated in FIG. 2 was used. Here, the aqueous solution 109*a* containing choline chloride of 50% was used as the deliquescent material. The measurement result in this case is shown in Table 2.

TABLE 2

SHEET MOISTURE AMOUNT OF 5.6% AFTER BEING MAINTAINED FOR 24 HOURS IN SURROUNDINGS WITHOUT SPRAYING

| | SHEET MOISTURE AMOUNT [%] | | |
|---|---|---|---|
| SOLUTION | IMMEDIATELY AFTER SPRAYING | AFTER ONE HOUR | AFTER 24 HOURS |
| CHOLINE CHLORIDE 50% | 10 | 6.8 | 6.6 |
| AQUEOUS SOLUTION | 8.5 | 6.2 | 6.2 |

As shown in Table 2 above, as a result of measurement of the moisture amount of the sheet 103 after being maintained for 24 hours in surroundings from spray of the aqueous solution 109 on the sheet 103, it is recognized that the moisture amount of the sheet 103 using the aqueous solution 109*a* containing the deliquescent material is greater than that not using the aqueous solution 109*a* containing the deliquescent material. In addition, it is recognized that the deliquescent material retains the moisture inside the sheet 103.

It is also recognized that, as the concentration of the deliquescent material in the aqueous solution 109 containing the deliquescent material sprayed onto the sheet 103 increases, the moisture retainability (moisture amount) increases.

Next, how much the ripple of the sheet 103 can be alleviated if the aqueous solution 109*a* containing the deliquescent material is sprayed onto the sheet 103 after the sheet 103 passes through the fixing unit 1 was measured. The height of the ripple of the sheet 103 was measured by spraying the aqueous solution 109*a* containing the deliquescent material onto the sheet 103 immediately after the sheet 103 passes through the fixing unit 1 using the spray nozzles 107*a* and 107*b* of the aqueous solution applying portion 2. The height of the ripple of the sheet 103 when twenty sheets 103 are loaded was measured. The height of the ripple of the sheet 103 was measured immediately after the spraying. The height of the ripple of the sheet 103 was also measured after 48 hours to see change of the height. In the surroundings, the temperature is set to about 23° C., and the humidity is set to about 40%.

In this case, the temperature of the fixation rotating body 101 of the fixing unit 1 was set to 170° C., and the rotation speed was 300 mm/sec. The temperature of the pressing rotating body 102 was set to 100° C., and the rotation speed was 300 mm/sec. Therefore, the velocity of the sheet 103 passing through an interval between the spray nozzles 107*a* and 107*b* of the aqueous solution applying portion 2 was 300 mm/sec.

As the aqueous solution 109 sprayed onto the sheet 103, an aqueous solution 109*a* containing choline chloride of 50% having deliquescence and an aqueous solution 109*a* containing N-methylmorpholine-N-oxide (MMNO) of 50% that has deliquescence and acts to separate the hydrogen bonding between fibers of paper were used. The N-methylmorpholine-N-oxide (MMNO) serving as the deliquescent material belongs to a compound group made of amine oxide. The measurement result in this case is shown in Table 3 as follows.

TABLE 3

| SOLUTION | CONCENTRATION [%] | MOISTURE AMOUNT IMMEDIATELY AFTER SPRAYING [%] | ELAPSED TIME [h] | HEIGHT OF RIPPLE [mm] |
|---|---|---|---|---|
| NO SPRAYING | NONE | 4.4 (NO SPRAYING) | 0 | 4.5 |
| | | 5.5 | 48 | 3.5 |
| CHOLINE CHLORIDE | 50 | 7.7 | 0 | 1.6 |
| | | 6.0 | 48 | 2.2 |
| N-methylmorpholine-N-oxide | 50 | 6.5 | 0 | 1.0 |
| | | 5.8 | 48 | 0.3 |

As shown in Table 3, the ripple of the sheet 103 is alleviated by spraying the aqueous solution 109*a* containing the deliquescent material onto the sheet 103. The ripple of the sheet 103 remains to be small without increasing even after 48 hours from the spraying. When the moisture is not sprayed, the moisture amount of the sheet 103 immediately after the sheet passes through the fixing unit 1 becomes 4.4%. When the sheet 103 is maintained in surroundings for 48 hours after it passes through the fixing unit 1, the moisture amount of the sheet 103 becomes 5.5%.

When the aqueous solution 109*a* containing choline chloride of 50% is sprayed onto the sheet 103, the moisture amount of the sheet 103 immediately after the spraying is 7.7%, and the moisture amount of the sheet 103 after 48 hours is 6.0%. When the aqueous solution 109*a* containing N-methylmorpholine-N-oxide of 50% as the deliquescent material is sprayed onto the sheet 103, the moisture amount of the sheet 103 immediately after the spraying becomes 6.5%, and the moisture amount of the sheet 103 after 48 hours from the spraying becomes 5.8%.

As a result, when the aqueous solution 109*a* containing the deliquescent material is sprayed, it is recognized that the moisture amount of the sheet 103 is maintained, and the height of the ripple of the sheet 103 is also reduced. Furthermore, when the sheet 103 is made of paper, the ripple of the sheet 103 can be significantly alleviated by using the aqueous solution 109*a* containing the deliquescent material acting to separate the hydrogen bonding between fibers of paper and dissolve celluloses.

In addition, similar to the N-methylmorpholine-N-oxide (MMNO), N-ethylmorpholine-N-oxide (EMNO) may be used as the deliquescent material to suppress the ripple and curling of the sheet 103.

Here, amine oxide or amine-N-oxide refers to a compound group having a general structure represented as R3N+-O— (as another expression, R3N═O, R3N→O). The dipole moment of an N→O semi-polar bonding of amine oxide exhibits a high ionization tendency. Due to such a salt-like property, amine oxide is easily dissolved in water and alcohol, and oxygen electrons in the N→O bonding have weak negative charges and tend to combine with hydrogen. Such a hydrogen bonding tendency is expressed as moisture absorbency of amine oxide.

A compound group made of amine is also a deliquescent material. For example, L-carnitine, N-methylglycine, benzyltrimethylammonium chloride (BtEAC), N-methylmorpholine-N-oxide (MMNO), or benzyltrimethylammonium chloride (BtMAC) may be used. In addition, choline chloride, acetamideethanol, thiminehy drochloride, pyrazole, or the like may be used. Here, amine refers to a substance obtained by substituting one or more hydrogen atoms of ammonia with a hydrocarbon group.

In addition, if the aqueous solution 109*b* containing the surfactant is mixed with the aqueous solution 109 in the aqueous solution applying portion 2, permeability to the sheet 103 of the aqueous solution 109 is improved by virtue of the action of the surfactant. As a result, the aqueous solution 109 is easily introduced into the gap between fibers of paper, and the action of separating the hydrogen bonding between fibers of paper and dissolving celluloses is promoted, so that a ripple or curling of the sheet 103 is alleviated.

If only water is applied, it has low permeability to sheet 103, and water droplets remain on the surface of the sheet 103. Therefore, adhesion between upper and lower sheets occurs when a plurality of sheets 103 is loaded. The loadability of the sheet 103 is improved by mixing the surfactant with the aqueous solution 109 to increase the permeability to the sheet 103 and allow the droplets on the surface of the sheet 103 to be quickly absorbed into the inner side of the sheet 103.

Here, the surfactant refers to a substance containing both hydrophilic and hydrophobic groups. The surfactant acts to uniformly mixing a polar substance and a non-polar substance by forming a Micelle, Vesicles, or Lamellar structure. In addition, it also acts to weaken the surface tension.

Figure 4B:
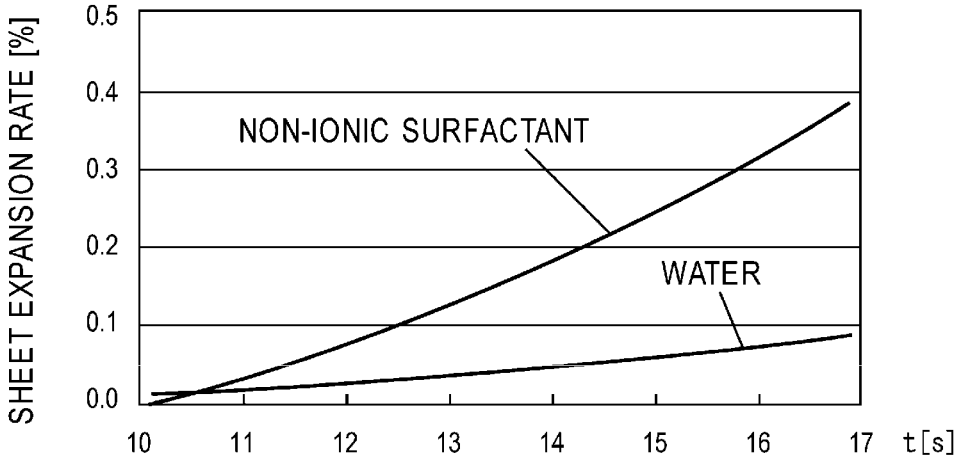
FIG. 4B is a diagram illustrating comparison of a sheet expansion rate between an aqueous solution containing surfactant and water.

As the surfactant of the present embodiment, acethylene glycol which is a non-ionic surfactant was used. FIG. 4B illustrates measurement of expansion and contraction of the sheet 103 when the aqueous solution 109*b* containing non-ionic surfactant of 1% and water is sprayed onto the sheet 103. Since the sheet 103 is expanded when the sheet 103 absorbs water, it can be determined that the permeability is high if the speed of expansion is high. From FIG. 4B, it is recognized that the permeability of the aqueous solution 109*b* containing the surfactant is higher than that of only water.

As described above, evaporation of the applied moisture is hindered by applying the aqueous solution 109*a* containing the deliquescent material to the sheet 103 so that a ripple or curling of the sheet 103 is continuously alleviated. Since the solution containing a nonvolatile material that makes a hydrogen bonding with fibers of paper and suppresses the hydrogen bonding between fibers is applied to the sheet 103 instead of moisture, the solution is introduced into the gap between fibers of paper, so that the hydrogen bonding between fibers is prevented regardless of dryness of the sheet 103. As a result, it is possible to continuously alleviate a ripple or curling of the sheet 103.

Furthermore, if the permeability of the aqueous solution 109 to the sheet 103 increases by mixing the surfactant with the aqueous solution 109 applied to the sheet 103, the aqueous solution 109 is easily introduced into the gap between fibers of paper. Therefore, the effect of separating the hydrogen bonding between fibers and dissolving celluloses also increases. In addition, a ripple or curling of the sheet 103 is alleviated. If only water is applied to the sheet 103, the permeability to the sheet 103 is insufficient. Therefore, water droplets remain on the surface of the sheet 103, and adhesion between upper and lower sheets occurs when a plurality of sheets 103 is loaded. The permeability of the aqueous solution 109 to the sheet 103 and the loadability of the sheet 103 are improved by mixing the surfactant with the aqueous solution 109 applied to the sheet 103.

When a ripple and curling of the sheet 103 is alleviated by applying moisture to the sheet 103 that has passed through the fixing unit 1, according to the present embodiment, the concentration of the deliquescent material is changed by the basis weight of the sheet 103 while the spray amount of the aqueous solution 109 is constantly maintained. As such, an optimal moisture amount can be maintained depending on the basis weight of the sheet 103 by changing the concentration of the deliquescent material of the aqueous solution 109 containing the deliquescent material sprayed onto the sheet 103. Therefore, it is possible to suitably alleviate the ripple in each sheet 103.

In addition, since the spray amount of the aqueous solution 109 to the sheet 103 is constant, feedability or loadability of the sheet 103 is stabilized. By applying the aqueous solution 109*a* containing the deliquescent material to the sheet 103, evaporation of the moisture applied to the sheet 103 is hindered, and a ripple or curling of the sheet 103 is continuously alleviated.

Since the solution containing a nonvolatile material that makes a hydrogen bonding with fibers of paper and suppresses the hydrogen bonding between fibers is applied to the sheet 103 instead of moisture, the solution is introduced into the gap between fibers of paper, so that the hydrogen bonding between fibers of paper is prevented regardless of dryness of the sheet 103. As a result, it is possible to continuously alleviate a ripple or curling of the sheet 103.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-247569, filed Nov. 4, 2010, and No. 2011-219903, filed Oct. 4, 2011 which are hereby incorporated by reference herein in their entirety.

What is claimed is:

1. An image forming apparatus comprising:

an image forming portion that forms a toner image on a sheet;

a fixing portion that thermally fixes the toner image formed on the sheet;

an aqueous solution applying portion that applies an aqueous solution containing a deliquescent material for hindering evaporation of moisture to the sheet where the toner image has been thermally fixed by the fixing portion; and a controller that controls the aqueous solution applying portion so that a concentration of the deliquescent material of the aqueous solution applied to the sheet by the aqueous solution applying portion is increased with increasing basis weight of the sheet.

2. The image forming apparatus according to claim 1, wherein the deliquescent material belongs to a compound group made of amine oxide.

3. The image forming apparatus according to claim 2, wherein, when the sheet, to which the aqueous solution is applied using the aqueous solution applying portion, is made of paper, the deliquescent material acts to separate a hydrogen bonding between fibers of paper and dissolve celluloses, and at least one of the deliquescent materials is a solution containing N-methylmorpholine-N-oxide (MMNO) or N-ethylmorpholine-N-oxide (EMNO).

4. The image forming apparatus according to claim 1, wherein the deliquescent material belongs to a compound group made of amine.

5. The image forming apparatus according to claim 4, wherein at least one of the deliquescent materials is a solution containing choline chloride.

6. The image forming apparatus according to claim 1, wherein the aqueous solution applied to the sheet using the aqueous solution applying portion contains a surfactant for promoting permeability of the aqueous solution to the sheet.

7. The image forming apparatus according to claim 1, wherein the aqueous solution applying portion is arranged to spray the aqueous solution onto both surfaces of the sheet, and the controller controls so that the aqueous solution is selectively applied to one or both sides of the sheet using the aqueous solution applying portion.

8. The image forming apparatus according to claim 1, wherein the aqueous solution applying portion includes a spray nozzle or a water-jet mechanism.

9. The image forming apparatus according to claim 1, wherein the controller controls so that the aqueous solution containing the deliquescent material is applied to the sheet before the sheet is dried by the fixing portion, and an equilibrium state is made between a moisture amount of the sheet and a moisture amount of surroundings.

10. The image forming apparatus according to claim 1, wherein the aqueous solution applying portion includes at least two or more reservoirs, at least a first reservoir stores the aqueous solution containing the deliquescent material, at least another second reservoir stores water, and a mixed aqueous solution obtained by mixing the aqueous solution of the first reservoir with water of the second reservoir is applied to the sheet where the toner image has been thermally fixed by the fixing portion.

11. The image forming apparatus according to claim 1, wherein the aqueous solution applying portion has at least two or more reservoirs, and at least one first reservoir stores an aqueous solution containing a deliquescent material, and at least one of another second reservoirs stores water, and the aqueous solution of the first reservoir and the water of the second reservoir are separately applied to the sheet where the toner image has been thermally fixed by the fixing portion.

12. The image forming apparatus according to claim 1, wherein a spray amount per unit area of the aqueous solution sprayed onto the sheet using the aqueous solution applying portion is constant regardless of a basis weight of the sheet.

13. The image forming apparatus according to claim 1, wherein the aqueous solution applying portion applies the aqueous solution containing the deliquescent material to the sheet in the middle of a sheet conveying path after the toner image is fixed onto the sheet.

* * * * *